US006838424B2

(12) United States Patent
Ozaki et al.

(10) Patent No.: US 6,838,424 B2
(45) Date of Patent: Jan. 4, 2005

(54) TWO-AGENT TYPE LIQUID BLEACHING COMPOSITIONS

(75) Inventors: Kazuyoshi Ozaki, Wakayama (JP); Masataka Maki, Wakayama (JP); Nobuyuki Ogura, Wakayama (JP); Muneo Aoyagi, Tokyo (JP)

(73) Assignee: Kao Corporation, Tokyo (JP)

( * ) Notice: Subject to any disclaimer, the term of this patent is extended or adjusted under 35 U.S.C. 154(b) by 273 days.

(21) Appl. No.: 10/191,065

(22) Filed: Jul. 10, 2002

(65) Prior Publication Data

US 2003/0119697 A1 Jun. 26, 2003

(30) Foreign Application Priority Data

Jul. 10, 2001 (JP) ..... 2001-209555
Jul. 31, 2001 (JP) ..... 2001-231687
Jul. 31, 2001 (JP) ..... 2001-231688

(51) Int. Cl.[7] ..... C11D 3/395
(52) U.S. Cl. ..... 510/375; 510/303; 510/376
(58) Field of Search ..... 510/302, 303, 510/376, 375

(56) References Cited

U.S. PATENT DOCUMENTS 5,266,233 A * 11/1993 Houghton et al. ..... 252/174.21
5,972,239 A * 10/1999 Coyle-Rees ..... 252/187.25
6,010,994 A 1/2000 Choy et al.
6,046,150 A 4/2000 Choy et al.

FOREIGN PATENT DOCUMENTS

| | | |
|---|---|---|
| JP | 60-38497 | 2/1985 |
| JP | 3-140400 | 6/1991 |
| JP | 6-166892 | 6/1994 |
| JP | 9-48997 | 2/1997 |
| JP | 9-151396 | 6/1997 |
| JP | 9-151397 | 6/1997 |
| JP | 9-151398 | 6/1997 |
| JP | 9-157693 | 6/1997 |
| JP | 2002-80894 | 3/2002 |
| WO | WO 95/16023 | 6/1995 |
| WO | WO 97/31087 | 8/1997 |
| WO | WO 98/23533 | 6/1998 |
| WO | WO 00/61712 | 10/2000 |
| WO | WO 00/61713 | 10/2000 |

* cited by examiner

*Primary Examiner*—Yogendra N. Gupta
*Assistant Examiner*—John M Petruncio
(74) *Attorney, Agent, or Firm*—Oblon, Spivak, McClelland, Maier & Neustadt, P.C.

(57) ABSTRACT

To provide two-agent type liquid bleaching compositions having excellent bleaching effect even if a mixing ratio of the two agents varies, great usability, and no problem in storage stability, two-agent type liquid bleaching compositions contains an agent A and an agent B filled and held in separate chambers of a container and comprises the agent A made of constituents containing 0.1 to 10% by weight of hydrogen peroxide and water and provided with certain buffering capacity, and the agent B made of constituents containing an alkali agent and water and provided with certain buffering capacity.

10 Claims, 2 Drawing Sheets

TWO-AGENT TYPE LIQUID BLEACHING COMPOSITIONS

FIELD OF INVENTION

The invention provides two-agent type liquid bleaching compositions, that is, a bleach product comprising two agents A and B comprising two liquid compositions, respectively, accommodated in two separate containers, respectively, used by mixing them with each other.

PRIOR ARTS

Liquid bleaching compositions containing hydrogen peroxide as a main component have been used preferably because of the advantages that they can be used for colored and patterned materials, be applied directly to stains and so on, and researches on two-agent type liquid bleaching compositions have been conducted aiming at enhancement of storage stability and bleaching performance.

Japanese Patent Application Laid-Open No. 3-140400 has disclosed two-agent type liquid bleaching compositions comprising an agent A containing hydrogen peroxide and an agent B containing a bleach activator, both of which are separated, and in its examples the two-agent type liquid bleaching compositions in which a pH of the agent A is 4.0 or 4.5 and a pH of the agent B is from 9.6 to 11.0 are described. However, the invention described in Japanese Patent Application Laid-Open No. 3-140400 did not mention that the two agents were used by mixing together at the same time prior to application, but described that these agents were mixed on stained substrates. In this case, if the agent B does not possess enough capacity to cope with changes in pH as an alkali agent, the pH of the agent B would be affected by acids present in stains, and moreover, even if the agent A and the agent B are mixed together at the same time and applied to stains, enough detergency cannot be expected.

In Japanese Patent Application Laid-Open No. 6-166892, two-agent type bleaching compositions comprising an agent A containing a surfactant and a bleach activator and an agent B containing a peroxide bleaching agent capable of producing hydrogen peroxide in an aqueous solution are described. However, the composition of this prior art does not describe inclusion of an alkali agent in an agent A or agent B, or does not suggest that the agent A and the agent B are each composed of an acid agent and an alkali agent, and therefore, enough detergency cannot be expected.

The invention disclosed in Japanese Patent Application Laid-Open No. 9-48997 is the most similar to the present invention. However, the kind of alkali agent usable in an agent B is not specified. In its examples, sodium carbonate that has been found desirable as an alkali agent in the present application is described, but the content of sodium carbonate is only 3.0% by weight, suggesting that enough bleaching performance cannot be attained. And also, when an alkali agent in the form of a sodium salt is contained at a high concentration, stability of liquid bleaching compositions would be affected, giving rise to formation of precipitates. In particular, when used in combination with a surfactant or other organic compounds, it is difficult to obtain a stable formulation.

In JP-A 9-151396 (corresponding to EP 744463), JP-A 9-151397 (corresponding to EP 744462), JP-A 9-151398 (corresponding to EP 744464), and JP-A 9-157693 (corresponding to EP 744465), a bleaching agent in which one composition containing an hydrophobic peracid precursor, an emulsifier to disperse the peracid precursor, and water and the other composition containing a liquid alkali source or a liquid peracid source are filled separately in a container having two chambers, is disclosed. However, these inventions are intended to stabilize the hydrophobic peracid precursor, and hydrogen peroxide may be included in the same agent as the alkali agent, which does not correspond to the specified element of the present invention.

Liquid bleaching compositions available commercially at present are generally used either by pouring a given volume into a cap and then applying to clothes or by loading into a washing machine. However, two-agent type bleaching compositions having an agent A and an agent B in two independent containers have a problem in workability, because one agent is measured with a cap and then the other is measured with the same cap. To design a container capable of measuring two liquids in one cap at the same time with the object of improving workability, pour spouts of the two liquids must be located closely to each other, but such a design would allow contamination of one liquid into the other container while handling. In addition, contamination caused by a small volume of the other liquid remaining on the inner wall of the cap could occur when the cap after measuring is placed back again. If one of the agents A or B is contaminated with the other, the problem of acceleration of hydrogen peroxide degradation and resultant bulging of the container to a significant degree may occur in the conventional two-agent type liquid bleaching compositions described above.

Another problem occurring with two-agent type liquid bleaching compositions is that the mixing proportion of the agent A to the agent B could vary upon repeated usage at home and so on. This is considered to be due to the fact that subtle holding angles of the container, decanting angles on measuring and so on differ in every operation to a slight degree, thereby affecting dispensing volumes of the two liquids and, in particular, the mixing proportions of the agent A to the agent B vary to a great extent between earlier use (initial several operations) and later use (last several operations). Therefore, it is desirable that the mixed liquid can maintain a high pH and achieve a high bleaching performance even if the mixing proportions vary.

Further problem is that two-agent type liquid bleaching compositions require inevitably higher ingredient concentrations for both agents, resulting in producing turbidity and precipitates after storage.

DISCLOSURE OF INVENTION

Accordingly, the objects of the present invention are to provide two-agent type liquid bleaching compositions which can achieve an excellent bleaching performance unaffected by the changes in mixing proportions, though hitherto unachieved, are supplied in a bottle featuring in ease of use and free from bulging, and further to provide two-agent type liquid bleaching compositions producing neither precipitation nor separation during storage.

The present invention relates to two-agent type liquid bleaching compositions comprising an agent A composed of constituents containing 0.1 to 10% by weight of hydrogen peroxide, an acid agent and water, and an agent B composed of constituents containing an alkali agent and water, both of which are filled and held in separate chambers of a container. The agent A and the agent B meet the following conditions of (I) and (II), respectively:

(I) A pH of an agent A ranges from 1 to 6.5 at 20° C. and a volume of aqueous 0.1 N sodium hydroxide solution required to adjust a pH of 1,000 ml of the agent A to 7 at 20° C. is from 50 to 1,000 ml; and (II) A pH of an agent B ranges from 9 to 12 at 20° C. and a volume of aqueous 1 N sulfuric acid solution required to adjust a pH of 1,000 ml of the agent B to 7 at 20° C. is from 450 to 2,000 ml.

The present invention also relates to a method of bleaching an article or substrate by mixing the agent A and the agent B with each other at a weight ratio ranging from 1/3 to 3/1 and then bringing the mixture into contact with the article or substrate. The agents A and B may be separated from each other before use.

It should be noted that the bleaching compositions used in the present invention may be used not only for a supplement to a detergent but also as an independent detergent.

DETAILED EXPLANATION OF INVENTION

Agent A

The agent A of the present invention is an aqueous composition which contains hydrogen peroxide, an acid agent and water, and is characterized by the condition of (I).

In the agent A, hydrogen peroxide is contained at from 0.1 to 10% by weight, preferably from 0.5 to 6% by weight, and more preferably from 1 to 6% by weight. Within this range of hydrogen peroxide, satisfactory bleaching effect can be achieved.

Also, the agent A of the present invention meets the condition of (I). In particular, the pH of the agent A at 20° C. is preferably from 1.5 to 5, and more preferably from 2 to 5 considering from the bleaching effect and storage stability, and the volume of aqueous 0.1 N sodium hydroxide solution required to adjust the pH of 1,000 ml of the agent A to 7 at 20° C. is preferably from 100 to 1,000 ml, and more preferably from 150 to 600 ml. Within this range, excellent storage stability can be achieved and bleaching effect is also high.

In the present invention, an acid agent is included in the agent A for the purpose of meeting the condition of (I) described above. The acid agent mentioned here in the present invention is preferably a substance having a solubility of 1 g or higher in 1 L of ion exchanged water at 20° C. and a pH of 5 or lower at 20° C. at a concentration of 1 g/1 L. Further, a preferable acid agent of the present invention is a compound having two or more acid functions with their acid dissociation constants, pKa, in water of from 1 to 8. The acid dissociation constant mentioned here in the present invention is the same as that described in "Kagakubinran Kisohen II" (3rd revised edition, edited by Chemical Society of Japan), pp.II 338–342.

Specifically, the following compounds are listed as preferable acid agents.

(1) Phosphoric acid series of compounds such as phosphoric acid, tripolyphosphoric acid, fitic acid (inosinic acid) and the like.

(2) Phosphonic acid series of compounds such as phosphonic acid, ethane-1,1-diphosphonic acid, ethane-1,1,2-triphosphonic acid, ethane-1-hydroxy-1,1-diphosphonic acid and its derivatives, ethanehydroxy-1,1,2-triphosphonic acid, ethane-1,2-dicarboxy-1,2-diphosphonic acid, methanehydroxyphosphonic acid, aminopoly (methylenephosphonic acid), and the like.

(3) Phosphonopolycarboxylic acid series of compounds such as 2-phosphonobutane-1,2-dicarboxylic acid, 1-phosphonobutane-2,3,4-tricarboxylic acid, α-methylphosphonosuccinic acid and the like.

(4) Aminopolycarboxylic acid series of compounds such as ethylenediaminediacetic acid, hydroxyethyliminodiacetic acid, iminodiacetic acid, nitrilotriacetic acid, ethylenediaminetetraacetic acid, diethylenetriaminepentaacetic acid, glycoletherdiaminetetraacetic acid, triethylenetetraminehexaacetic acid, jenkoic acid, and the like.

(5) Amino acids such as aspartic acid, glutamic acid, glycine and the like.

(6) Organic acids such as citric acid, succinic acid, maleic acid, phthalic acid, terephthalic acid, isophthalic acid, fumaric acid, adipic acid, azelaic acid, diglycolic acid, oxydisuccinic acid, carboxymethyloxysuccinic acid, citric acid, lactic acid, tartaric acid, oxalic acid, glutaric acid, malic acid, gluconic acid, carboxymethylsuccinic acid, carboxymethyltartaric acid and the like.

(7) Boric acids such as metaboric acid, orthoboric acid and the like.

Among these compounds, preferable acid agents blended in the agent A are one or more compounds selected from ethane-1-hydroxy-1,1-diphosphonic acid and ethane-1,1-diphosphonic acid.

These acid agents may also be used as a sequestering agent of metal ion as described later. The amount of acid agents blended in the agent A is added in the range meeting the condition for pH; however, from the standpoint of storage stability, its amount blended is preferably in the range from 0.1 to 10% by weight, more preferably from 0.2 to 5% by weight, and most preferably from 0.2 to 3% by weight.

To the agent A of the present invention, an alkali agent may be added as long as the condition for pH described above is satisfied. The alkali agent referred to in the present invention indicates a compound that shows an alkaline property upon adding to ion exchanged water. This alkali agent may be that described later.

Water is contained in the agent A of the present invention. The water is preferred to be distilled water or ion exchanged water. The content of water in the agent A is preferably from 50 to 99% by weight, and more preferably from 60 to 95% by weight.

In the present invention, more efficient bleaching effect can be achieved by including further, in the agent A, a bleaching activator having an ester group, an imide group or a nitrile group preferably from 0.05 to 10% by weight, more preferably from 0.1 to 5% by weight, and most preferably from 0.1 to 1% by weight.

In particular, the compound represented by the following general formula (1) is preferable as the bleach activator:

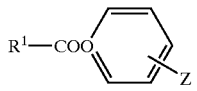

(1)

(Wherein, $R^1$ represents a straight chain or branched chain alkyl or alkenyl group having from 5 to 19 carbon atoms, and Z represents —$SO_3M$ or COOM, in which M represents an organic or inorganic cation.)

Specifically preferable examples are: octanoyloxy-p-benzenesulfonic acid, nonanoyloxy-p-benzenesulfonic acid, 3,5,5-trimethylhexanoyloxy-p-benzenesulfonic acid, decanoyloxy-p-benzenesulfonic acid, dodecanoyloxy-p-benzenesulfonic acid, octanoyloxy-o- or -p-benzenecarboxylic acid, nonanoyloxy-o- or -p-benzenecarboxylic acid, 3,5,5-trimethylhexanoyloxy-o- or -p-benzenecarboxylic acid, decanoyloxy-o- or -p-benzenecarboxylic acid, dodecanoyloxy-o- or -p-benzenecarboxylic acid, and their salts. As the salts, sodium salt, potassium salt and magnesium salt are preferable, and especially sodium salt is preferable from the standpoint of solubility.

Among these compounds, nonanoyloxy-p-benzenesulfonic acid, decanoyloxy-p-benzenesulfonic acid, dodecanoyloxy-p-benzenesulfonic acid and their salts are particularly preferable from the standpoint of bleaching performance of lipophilic stains.

In blending the bleaching activator of the general formula (1) in the agent A, it is preferable to use the stabilizing method for stabilization as described in JP-A 6-207196 (corresponding to European Patent Application Laid-Open No. EP 670364), JP-A 7-82591, JP-A 7-216397 and JP-A 7-331289 and the like.

Agent B

The agent B of the present invention contains an alkali agent and water, and meets the condition of (II).

Particularly, in the condition of (II), the pH at 20° C. is preferably from 9.5 to 11.5 and more preferably from 10 to 11. And the volume of aqueous 1 N sulfuric acid solution required to adjust the pH of 1,000 ml of the agent B to 7 at 20° C. is preferably from 450 to 1,500 ml, and more preferably from 500 to 1,000 ml. Within this range, excellent stability such as suppression of precipitation and so on during storage or after freezing, and excellent bleaching performance can be achieved. As the alkali agent to provide the agent B with such properties, one or more of the compounds selected from sodium hydroxide, potassium hydroxide, sodium carbonate, potassium carbonate, monoethanolamine, diethanolamine, triethanolamine, trisodium phosphate, disodium hydrogen phosphate, sodium tetraborate are named. For the agent B, it is preferable to use one or more of the compounds selected from sodium carbonate, potassium carbonate and monoethanolamine, and most preferable to use potassium carbonate. These alkali agents are contained in the agent B preferably at 3.5 to 15% by weight, more preferably at 4 to 10% by weight, and most preferably at 5 to 8% by weight.

It is preferable to use distilled water or ion exchanged water for the agent B of the present invention. The content of water in the agent B is preferably from 30 to 99% by weight, and more preferably from 50 to 95% by weight.

Further, in order to meet the condition of (II) described above, an acid agent may be blended to the agent B as required, in addition to the alkali agent mentioned above. The acid agent may be chosen from the one listed for the agent A described above.

It should be noted that, when sodium hydroxide or potassium hydroxide is blended as the alkali agent at 3.5% or more by weight, the pH becomes outside of the condition of (II). When sodium hydroxide or potassium hydroxide is employed, it is possible to meet the condition of (II) by using another alkali agent in combination or by adjusting it to a more preferable pH with use of an acid agent listed for the agent A. Incidentally, the combined use of sodium hydroxide or potassium hydroxide with an acid agent falls into the same situation as the use of an acid salt, and when the latter salt turns out to be the same compound as that listed for the alkali agent described above, the salt concentration is counted as an alkali agent. Further, there is a case that a salt of the acid agents to be mentioned later turns out to be the same as a chelating agent. If such a salt is listed as an alkali agent, then it is considered to be an alkali agent. If such a salt is not listed above as an alkali agent, it is considered as a chelating agent.

The agent B of the two-agent type liquid bleaching compositions of the present invention contains potassium ion preferably at 1.5 to 10% by weight, more preferably at 2 to 8.5% by weight, and most preferably at 2 to 6% by weight in order to attain an excellent bleaching performance without loss of stability against turbidity or precipitation during storage or after freezing. As a source of potassium ion, potassium compounds of the alkali agents described above are named, and potassium carbonate is preferable for the present invention. In particular, the ratio of potassium ion to a total of alkali metal ion and alkali-earth metal ion present in the agent B is preferably between 50 and 100% by weight, and more preferably between 60 and 95% by weight. It should be noted that the contents of potassium ion and other alkali metal ion and alkali-earth metal ion are measured by atomic absorption spectroscopy.

When the two-agent type liquid bleaching compositions of the present invention contains, in the agent A, a bleaching activator, particularly the bleaching activator shown in the general formula (1) described above for the sake of attaining a higher bleaching performance, still higher bleaching performance is achieved by including further in the agent B an amine oxide-type surfactant shown below by the general formula (2) at 0.01 to 50% by weight, particularly at 0.1 to 20% by weight, and more particularly at 0.5 to 5% by weight, because the formation rate of an organic peracid produced from the bleaching activator is enhanced.

As an amine oxide-type surfactant, the compound represented by the following formula (2) exerts the highest bleaching effect:

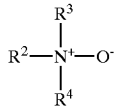

(2)

(wherein, at least one of $R^2$, $R^3$, or $R^4$ represents a straight chain or branched chain alkyl or alkenyl group which may be interrupted by an ester bond, an amide bond or an ether bond and has from 6 to 22 carbon atoms, preferably from 8 to 20, and most preferably from 8 to 15 and the other groups represent alkyl or hydroxyalkyl groups having from 1 to 5 carbon atoms, and preferably from 1 to 3 carbon atoms.)

Specifically, preferable compounds are selected from the compounds having the following general formula (2-a):

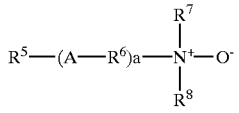

(2-a)

(wherein, $R^5$ is a straight chain alkyl or alkenyl group having from 8 to 16 carbon atoms, preferably from 10 to 16, and most preferably from 10 to 14, and $R^7$ and $R^8$ are alkyl or hydroxyalkyl groups each having from 1 to 3 carbon atoms. $R^6$ is an alkylene group having from 1 to 5 carbon atoms, preferably 2 or 3 carbon atoms. A is a group selected from —COO—, —CONH—, —OCO—, —NHCO— and —O—, and a is an integer of zero or 1, preferably 1.)

In order to enhance cleaning efficiency, the agent B of the present invention is further supplemented with a solvent. The preferable solvent includes (i) monohydric alcohol having 1 to 5 carbon atoms, (ii) polyhydric alcohol having 2 to 12 carbon atoms, (iii) the compound represented by the general formula (3) as shown below, (iv) the compound represented by the general formula (4) as shown below, and (v) the compound represented by the general formula (5) as shown below:

$$R^9O(C_2H_4O)_b(C_3H_6O)_cR^{10} \quad (3)$$

(4)

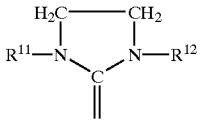

$$R^{13}OCH_2CH(OH)CH_2OH \quad (5)$$

(wherein, $R^9$ and $R^{10}$ each represents hydrogen atom, an alkyl group having from 1 to 6 carbon atoms, a phenyl group or a bezyl group, and the case in which both $R^9$ and $R^{10}$ are hydrogen atom at the same time is excluded. And b represents an integer of from 0 to 10, and c represents an integer of from 0 to 10, where both b and c should not be 0 at the same time. $R^{11}$ and $R^{12}$ each represents an alkyl group having from 1 to 3 carbon atoms, and $R^{13}$ represents an alkyl group having from 1 to 8 carbon atoms.)

The monohydric alcohol of (i) having from 1 to 5 carbon atoms includes, in general, ethanol, propyl alcohol, and isopropyl alcohol. Blending of these lower alcohols enables to improve further stability of the system at a low temperature.

The polyhydric alcohol of (ii) having from 2 to 12 carbon atoms includes isoprene glycol, 2,2,4-trimethyl-1,3-pentanediol, 1,8-octanediol, 1,9-nonanediol, ethylene glycol, propylene glycol, diethylene glycol, dipropylene glycol, glycerol, and the like.

It is particularly preferable for the compound (iii) that the number of carbon atoms is from 1 to 4, when $R^9$ and $R^{10}$ are alkyl groups in the general formula (3). Further, b and c in the general formula (3), each representing an average addition number of ethylene oxide and propylene oxide in moles, are an integer of from 0 to 10 (where both b and c should not be 0 at the same time), and the sequence of the addition is not limited specifically, allowing a random mode of addition. Specific examples of the compound (iii) include ethylene glycol monobutyl ether, dipropylene glycol dimethyl ether, diethylene glycol monoethyl ether, diethylene glycol monobutyl ether, propylene glycol monomethyl ether, propylene glycol monobutyl ether, propylene glycol monoethyl ether, propylene glycol dimethyl ether, polyoxyethylene (p=2 to 3) polyoxypropylene (p=2 to 3) glycol dimethyl ether (p refers to an average addition number in moles), polyoxyethylene (p=3) glycol phenyl ether, phenylcarbitol, phenyl cellosolve, benzyl Carbitol and the like. Among them, propylene glycol monomethyl ether, diethylene glycol monobutyl ether, polyoxyethylene (p=1 to 4) glycol monophenyl ether are preferable in view of cleaning action and usability.

Further, preferable examples of the compound (iv) are 1,3-dimethyl-2-imidazolidinone and 1,3-diethyl-2-imidazolidinone.

And preferable examples of the compound (v) are alkylglyceryl ether compounds, preferably a compound in which R13 is an alkyl group having from 3 to 8 carbon atoms.

Among the above solvents, in order to meet the property of the present invention, water soluble (i), (ii), (iii), and (v) are preferable and a particular solvent is preferably selected from ethanol, isopropyl alcohol, ethylene glycol, propylene glycol, diethylene glycol, dipropylene glycol, glycerol, isoprene glycol, propylene glycol monomethy ether, propylene glycol monoethyl ether, pentylglyceryl ether, octylglyceryl ether, and polyoxyethylene (p=1 to 4) glycol monophenyl ether.

It is suitable for the agent B of the present invention to contain such a solvent at 0 to 20% by weight, and more suitably at 5 to 20% by weight.

Other Ingredients

In the present invention, a surfactant is preferably included in the agent A and/or the agent B in order to enhance bleaching and cleaning performance. As the surfactant, it is preferable that one or more species are selected from nonionic surfactants, cationic surfactants, anionic surfactants, or amphoteric surfactants.

For the nonionic surfactant, a compound having the general formula (6) is preferable:

$$R^{14}—T—[(R^{15}O)_d—H]_e \quad (6)$$

(wherein, $R^{14}$ is an alkyl or alkenyl group having from 8 to 20 carbon atoms, preferably from 10 to 18, and more preferably from 10 to 16 carbon atoms, and $R^{15}$ is an alkylene group having 2 or 3 carbon atoms, and is preferably an ethylene group. The subscript d represents an integer of from 2 to 20, preferably from 4 to 15, and most preferably from 5 to 10. The subscript e represents an integer of 1 or 2. T represents —O—, 'CON— or —N—, and e is 1 when T is —O—, while e is 2 when T is —CON— or —N—.)

As specific examples of the compounds shown by the general formula (3), the following compounds can be listed:

$$R^{14}—O—(C_2H_4O)_f—H \quad (6\text{-a})$$

(wherein, $R^{14}$ means the same as above. The subscript f represents an integer of from 4 to 15, and preferably from 5 to 10.)

$$R^{14}—O—(C_2H_4O)_g—(C_3H_6O)_h—H \quad (6\text{-b})$$

(wherein, $R^{14}$ means the same as above. The subscripts g and h represents independently of an integer of from 2 to 15, preferably from 2 to 10, and both ethylene oxide and propylene oxide may be either in a random or block addition form.)

(6-c)

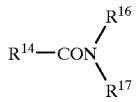

(6-d)

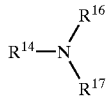

(wherein, $R^{14}$ means the same as above. $R^{16}$ is a methyl group, an ethyl group, or $—(C_2H_4O)_i—H$, and $R^{17}$ is $—(C_2H_4O)_j—H$, in which i and j each represents an integer from 0 to 5 and i plus j is from 1 to 6.)

In the present invention, it is preferable for a nonionic surfactant to be selected specifically from (6-a) or (6-b) among a variety of these surfactants.

A desirable cationic surfactant for use is a form of cationic surfactant having monoalkyl (or monoalkenyl) of long chain and trialkyl of short chain that is represented by the following general formula (7):

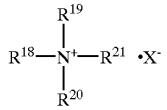

(7)

(wherein, $R^{18}$ is an alkyl or alkenyl group having from 8 to 18 carbon atoms, preferably from 10 to 18, and more preferably from 10 to 16, and $R^{19}$, $R^{20}$ and $R^{21}$ are alkyl groups having from 1 to 3 carbon atoms, and may be either identical or different one another. $X^-$ is an anion, and is preferably a halogen ion, an alkylsulfate ester ion having from 1 to 3 carbon atoms, a fatty acid ion having from 1 to 12 carbon atoms, or an arylsulfonic acid ion which may possess 1 to 3 substituents having from 1 to 3 carbon atoms.)

As the amphoteric surfactant, a compound represented by the following general formula (8) may be used in addition to a compound represented by the general formula (2) as described above:

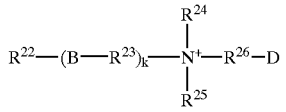

(8)

(wherein, $R^{22}$ is an alkyl or alkenyl group having from 9 to 23 carbon atoms, preferably from 9 to 17 carbon atoms and particularly preferably from 10 to 16 carbon atoms, and $R^{23}$ is an alkylene group having from 1 to 6 carbon atoms, preferably from 1 to 4 carbon atoms and particularly preferably 2 or 3 carbon atoms. B is a group selected from —COO—, —CONH—, —OCO—, —NHCO— and —O—, and k is an integer of 0 or 1, and is preferably 0. R24 and R25 each is an alkyl or hydroxyalkyl group having from 1 to 3 carbon atoms and preferably a methyl group, an ethyl group or a hydroxyethyl group, and R26 is an alkylene group having from 1 to 5 carbon atoms, and preferably from 1 to 3 carbon atoms, in which the alkylene group may be substituted by hydroxyl group. D is a group selected from $—SO_3—$ and $—OSO_3—$, and particularly $—SO_3—$ is suitable with respect to bleaching and cleaning effect.)

As the anionic surfactant, suitable anionic surfactants preferably possess an alkyl or alkenyl group having from 10 to 18 carbon atoms, preferably from 10 to 16, and more preferably from 10 to 15, and $—SO_3M—$ group and/or $—OSO_3M$ group (M: counter ion) in one molecule. Specifically, preferable compounds include alkylbenzenesulfonic acid, alkyl (or alkenyl) sulfate, polyoxyalkylenealkyl (or alkenyl) ether sulfate, olefinesulfonic acid, alkanesulfonic acid, α-sulfofatty acid, α-sulfofatty acid ester and their salts, all of which have the number of carbon atoms described above. Among the above, it is particularly preferable to blend one or more compounds selected from alkyl (or alkenyl) sulfate having alkyl or alkenyl group of 10 to 16 carbon atoms, polyoxyethylenealkyl (or alkenyl) ether sulfate in which the alkyl or alkeny group has from 10 to 16 carbon atoms and an average addition number of ethylene oxide (hereinafter abbreviated as EO) in moles is from 1 to 6, preferably from 1 to 4, and particularly preferably from 1 to 3, alkylbenzenesulfonic acid having alkyl group of 10 to 15 carbon atoms, and their salts. As the salts, sodium salt, potassium salt, ammonium salt and alkanolamine salt are suitable from the standpoint of storage stability.

The agent A of the present invention may contain, from the standpoint of bleaching and cleaning performance, the nonionic surfactant preferably at 0.5 to 15% by weight and more preferably at 1 to 10% by weight, the cationic surfactant preferably at 0.1 to 2% by weight and more preferably at 0.1 to 1% by weight, and the amphoteric surfactant preferably at 0 to 10% by weight and more preferably at 0.1 to 5% by weight.

The agent B of the present invention may contain, from the standpoint of bleaching and cleaning performance, the nonionic surfactant preferably at 0 to 40% by weight and more preferably at 1 to 35% by weight, and the anionic surfactant preferably at 0 to 30% by weight and more preferably at 0.1 to 10% by weight, the amphoteric surfactant preferably at 0 to 15% by weight and more preferably at 0.5 to 5% by weight, and the cationic surfactant preferably at 0 to 10% by weight and more preferably at 0.1 to 5% by weight. It should be noted that the amine oxide form of surfactant shown by the general formula (2) may be preferably blended in the agent B.

In the present invention, it is preferable for the agent A and/or the agent B to blend a carboxylic acid type polymer such as homopolymer of acrylic acid, methacrylic acid or maleic acid, copolymer made of these monomers, copolymer of one of these monomers with another monomer capable of copolymerizing with the former monomer, or the like in order to improve detergency.

The weight average molecular weights of these carboxylic acid type polymers are preferably from 3,000 to 100,000, and more preferably from 5,000 to 80,000. The weight average molecular weight can be determined by gel permeation chromatography using polyethylene glycols as standards.

Further, these carboxylic acid type polymers maybe a salt thereof neutralized in part and/or wholly with an alkali agent. A preferable alkali agent is a compound containing an alkali metal such as sodium, potassium, or the like.

Specifically, preferable example is sodium (or potassium) salt of polyacrylic acid or polymethacrylic acid having an average molecular weight of from 3,000 to 30,000, or sodium (or potassium) salt of acrylic acid-maleic acid copolymer having an average molecular weight of from 20,000 to 100,000 and more preferably from 50,000 to 80,000. In case of the acrylic acid-maleic acid copolymer, the weight ratio of acrylic acid to maleic acid is preferably from 5/5 to 9/1, and more preferably from 6/4 to 8/2 in view of cleaning effectiveness.

In the present invention, the content of the above carboxylic acid type polymer is preferably from 0 to 10% by weight, and more preferably from 0.1 to 7% by weight in the agent A, and preferably from 0.5 to 10% by weight, and more preferably from 1 to 8% by weight in the agent B.

Furthermore, it is preferable for the agent A and/or the agent B to contain a sequestering agent. The sequestering agent to be used in the present invention includes the following (i) to (viii), and among them, preferably at least one member selected from (ii), (v), (vi), and (vii), and more preferably at least one member selected from (ii):

(i) Alkali metal salts or alkanolamine salts of phosphoric acid series of compounds such as fitic acid and the like;

(ii) Alkali metal salts or alkanolamine salts of phosphonic acid compounds such as ethane-1,1-diphosphonic acid, ethane-1,1,2-triphosphonic acid, ethane-1-hydroxy-1,1-diphosphonic acid and its derivatives, ethanehydroxy-1,1,2-triphosphonic acid, ethane-1,2-dicarboxy-1,2-diphosphonic acid, methanehydroxyphosphonic acid, and the like;

(iii) Alkali metal salts or alkanolamine salts of phosphonocarboxylic acids such as 2-phosphonobutane-1,2-dicarboxylic acid, 1-phosphonobutane-2,3,4-tricarboxylic acid, α-methylphosphonosuccinic acid and the like;

(iv) Alkali metal salts or alkanolamine salts of amino acids such as aspartic acid, glutamic acid, glycine and the like;

(v) Alkali metal salts or alkanolamine salts of aminopolyacetic acids such as nitrilotriacetic acid, iminodiacetic acid, ethylenediaminetetraacetic acid, diethylenetriaminepentaacetic acid, glycoletherdiaminetetraacetic acid, hydroxyethyliminodiacetic acid, triethylenetetraminehexaacetic acid, jenkoic acid and the like;

(vi) Alkali metal salts or alkanolamine salts of organic acids such as diglycolic acid, oxydisuccinic acid, carboxymethyloxysuccinic acid, citric acid, lactic acid, tartaric acid, oxalic acid, malic acid, oxydisuccinic acid, gluconic acid, carboxymethylsuccinic acid, carboxymethytartaric acid and the like;

(vii) Alkali metal salts or alkanolamine salts of aluminosilicic acids represented by zeolite A; and (viii) Alkali metal salts or alkanolamine salts of aminopoly (methylenephosphonic acid), or alkali metal salts or alkanolamine salts of polyethylenepolyaminepoly (methylenephosphonic acid).

The content of such a sequestering agent in the agent B is preferably from 0 to 5% by weight, and more preferably from 0.01 to 1% by weight.

In the agent A and/or the agent B of the present invention, known components to be added conventionally to bleaching agents may be included in addition to the above components. For example, known stabilizing agents for hydrogen peroxide including magnesium salts such as magnesium sulfate, magnesium silicate, magnesium chloride, magnesium silicofluoride, magnesium oxide, magnesium hydroxide, and the like, or silicic acid salts such as sodium silicate may be preferably used. Furthermore, it is preferable to add an anti-redeposition agent such as carboxymethylcellulose, polyvinylpyrrolidone and polyethylene glycol.

Further, a variety of additional compounds may be included in the agent A and/or the agent B of the present invention. For example, known stabilizing agent of hydrogen peroxide such as phosphoric acid, barbituric acid, uric acid, acetanilide, aminopolycarboxylic acids represented by oxyquinoline, phenacetin and the like, DL-α-tocopherol, gallic acid derivatives, butylated hydroxyanisole (BHA), 2,6-di-tert-butyl-4-methylphenol (BHT) or the like may be preferably added. It is preferable for these stabilizing agents to be added to the agent A and/or the agent B generally at about 0 to 5% by weight, and more preferably at 0.01 to 3% by weight.

Still further, it is preferable for the agent A and/or the agent B of the present invention to contain substances known as an anti-color change/deterioration agent. These substances include amino acids such as phenylalanine, histidine, lysine, tyrosine, methionine and the like and salts thereof, amino or imido compounds such as hydroxyiminodiacetic acid and the like, copolymer of acrylonitrile or acrylonitrile derivative having a quaternary ammonium group with one or more kinds of monomers capable of copolymerizing with the former compounds, and the like. It should be noted that, although optical isomers are present in amino acids, optical isomers do not exert any effect in the present invention. Accordingly, chemically synthesized amino acids can also be utilized.

In order to enhance bleaching effect on fibers to be bleached, it is preferable to blend, in the agent A and/or the agent B of the present invention, a fluorescent brightening agent such as Tinopal CBS (produced by Ciba Geigy), Tinopal SWN (produced by Ciba Geigy), Color Index fluorescent brightener 28, 40, 61 and 71, or the like, and conventionally known enzymes (cellulase, amylase, protease, lipase) to improve bleaching performance as required.

In addition, it is preferable for the agent A and/or the agent B of the present invention to blend a variety of small and suitable amounts of additives including colorants such as dye and pigment, aromatic, silicone compounds, microbicide, UV absorbent, and the like.

Besides the components described above, known components of conventional additives may be included. For the purposes of improving liquid stability at a low temperature and restorable property after freezing, as well as preventing from liquid separation at a high temperature, it is preferable to blend a hydrotrope agent. For such a hydrotrope agent, preferable agents are, in general, short chain alkylbenzenesulfonic acid salts represented by toluenesulfonic acid salts, xylenesulfonic acid salts or the like, and alcohols and polyalcohols represented by ethanol, ethylene glycol, propylene glycol, hexylene glycol, glycerol, or the like. The hydrotrope agent is preferably added at 0 to 30% by weight in the agent A and/or the agent B.

Viscosity Characteristic

The viscosity of both of the agent A and the agent B at 20° C. is adjusted preferably within the range from 3 to 300 mPa.s, and more preferably within 4 to 200 mPa.s. For such adjustment of viscosity, a viscosity-adjusting agent may be added to the agent A and/or the agent B of the present invention. Usable viscosity adjusting agents are benzenesulfonic acids substituted with 1 to 3 alkyl groups of 1 to 3 carbon atoms or substituted with 1 to 3 hydroxyl groups, and polyethylene glycol or polypropylene glycol having a molecular weight of from 3,000 to 100,000. The content of such viscosity adjusting agents in the agent A and/or the agent B is preferably from 0 to 10% by weight, and more preferably from 0.01 to 5% by weight. The viscosity is measured at 20° C. by a B-type viscometer (Brookfield type viscometer; Tokyo Keiki Co., Ltd.) using rotor No. 1 at 60 rpm.

pH of Mixture

When equal volumes of the agent A and the agent B meeting the condition of (I) and (II), respectively, are mixed, it is preferable that the pH value at 20° C. is 8.5 or higher, preferably 8.8 or higher and more preferably 9.5 or higher, and its upper limit is 11.5 or lower and more preferably 11.0 or lower.

In the present invention, bleaching and cleaning are performed, in particular, after mixing the agent A and the agent B described above, and in view of bleaching effect, it is preferable that a high pH is obtained even if the mixing ratio varies. Because of this, when the mixing weight ratio of the agent A to the agent B is varied within 1/3 to 3/1, further within 1/5 to 5/1, and still further within 1/10 to 10/1, it is preferable in the present invention that pH of the mixture becomes 8.5 or higher at 20° C. in any range of the above weight ratio. Said pH is preferably 8.8 or higher, more preferably 9.5 or higher and most preferably 9.8 or higher, and with respect to the upper limit, preferably 11.5 or lower and more preferably 11 or lower. As long as pH of said mixture lies within the range described above in any of the above mixing ratio, enough bleaching effect is obtained.

In order to attain a better bleaching effect, a mixed solution, in which the mixing weight ratio of the agent A to the agent B is varied within 1/3 to 3/1, further within 1/5 to 5/1, and still further within 1/10 to 10/1, followed by dilution with water to 0.1% by weight, preferably has a pH value, at 20° C., 8.5 or higher, and more preferably 8.8 or higher, and the upper limit is preferably 11.5 or lower and more preferably 11 or lower in any range of the above weight ratio. For this purpose, it is preferable to blend the aforementioned alkali agent for the agent B at 4.0 to 10.0% by weight, and particularly at 5 to 8% by weight.

In order to attain still better stability and bleaching effect, when X (ml) represents a volume of aqueous 0.1 N sodium hydroxide solution required to adjust 1,000 ml of the agent A to pH 7 at 20° C. and Y (ml) represents a volume of aqueous 1 N sulfuric acid solution required to adjust 1,000 ml of the agent B to pH 7 at 20° C., the relation between X and Y is preferably $(Y/10)<X<Y\times(10/3)$, and more preferably $(Y/10)<X<Y$.

It is preferable that the two-agent type liquid bleaching compositions of the present invention is used for bleaching and cleaning of fiber products, particularly for apparel.

The two-agent type liquid bleaching compositions of the present invention may be used for bleaching and cleaning by dissolving the agent A and the agent B in tap water (preferably from 0.05 to 30% by weight), followed by soaking apparel in the solution. Further, the two-agent type liquid bleaching compositions of the present invention may also be used by mixing with conventional and known detergents. At the time of bleaching, it is also preferable for the agent A and/or the agent B to be warmed up to 30 to 50° C.

Further, the two-agent type liquid bleaching compositions of the present invention may be used in a bleaching method in which apparel is directly applied with the compositions, left standing, and then washed with water. Still further, after directly applied to apparel and left standing, washing may be done by mixing with conventional and known detergents in an ordinary washing machine. The time for being left after application is preferably from 0 to 180 minutes, and more preferably from 1 to 60 minutes.

When the two-agent type liquid bleaching compositions of the present invention are used as a detergent for apparel, washing can be done in a washing machine in an ordinary manner using the two-agent type liquid bleaching compositions of the present invention, or washing can also be done in a washing machine in an ordinary manner after the compositions are directly applied to apparel and left standing.

The present invention provides also a bleaching method in which the agent A having a composition containing hydrogen peroxide of 0.1 to 10% by weight, acid agent and water, and meeting the condition of (I) described above, and the agent B having a composition containing alkali agent and water, and meeting the condition of (II) described above are mixed at a weight ratio ranging from 1/3 to 3/1, and then contacted with a substrate.

The method in which the agent A and the agent B are premixed within a range from 1/3 to 3/1 and then applied directly to a substrate or put into a washing machine can provide an evidently superior bleaching effect compared with the method where the agent A and the agent B are applied to a substrate surface without premixing with each other or put into a washing machine separately.

From the above, it is preferable in view of bleaching and cleaning effects to design the compositions of the agent A and the agent B or their container so that the mixing ratio of the agent A to agent B may become, at the time of pouring, from 1/10 to 10/1, preferably from 1/5 to 5/1, and more preferably from 1/3 to 3/1.

BRIEF DESCRIPTION OF THE DRAWINGS

In the drawings, numerical references are:

(11), (12): Chamber to hold the agent A or the agent B
(13): Partition wall
(14): Pour spout
(1-1): Cap In other words, it is preferable that the two-agent type liquid bleaching compositions of the present invention utilize a container equipped with a pour spout through which the agent A and the agent B can be discharged simultaneously in order to make it possible for the mixing ratio described above to be readily attained. The container should be able to retain the agent A and the agent B separately. For example, it may be an all-in-one container capable of retaining the agent A and the agent B in separate storage chambers or a combined container in which one container capable of retaining the agent A and the other container capable of retaining the agent B are joined in one unit with an appropriate member. In particular, the area ratio of the pour spout for the agent A to that of the agent B is from 1/10 to 10/1, preferably 1/5 to 5/1, and more preferably from 1/3 to 3/1 for the purpose of adjusting the discharge volume. Adjustment of the discharge volume may be achieved by altering the viscosity of the agent A and the agent B, and the opening area or shape of the pour spout according to known methods. Illustrations of the specific container are shown in FIG. 1 and FIG. 2. In FIG. 1, (11) and (12) are retaining chambers for the agent A and the agent B, where one chamber retains the agent A and the other retains the agent B. Both chambers are separated by a partition wall (13), and the agent A and the agent B are retained separately in the container. The part shown by (14) is a pour spout to discharge the agent A and the agent B at the same time. In FIG. 2, (21) and (22) are containers for the agent A and the agent B, where one container retains the agent A and the other retains the agent B. These are joined in one unit by the joining part (23). The part shown by (24) is a pour spout to discharge the agent A and the agent B at the same time.

Figure 1:
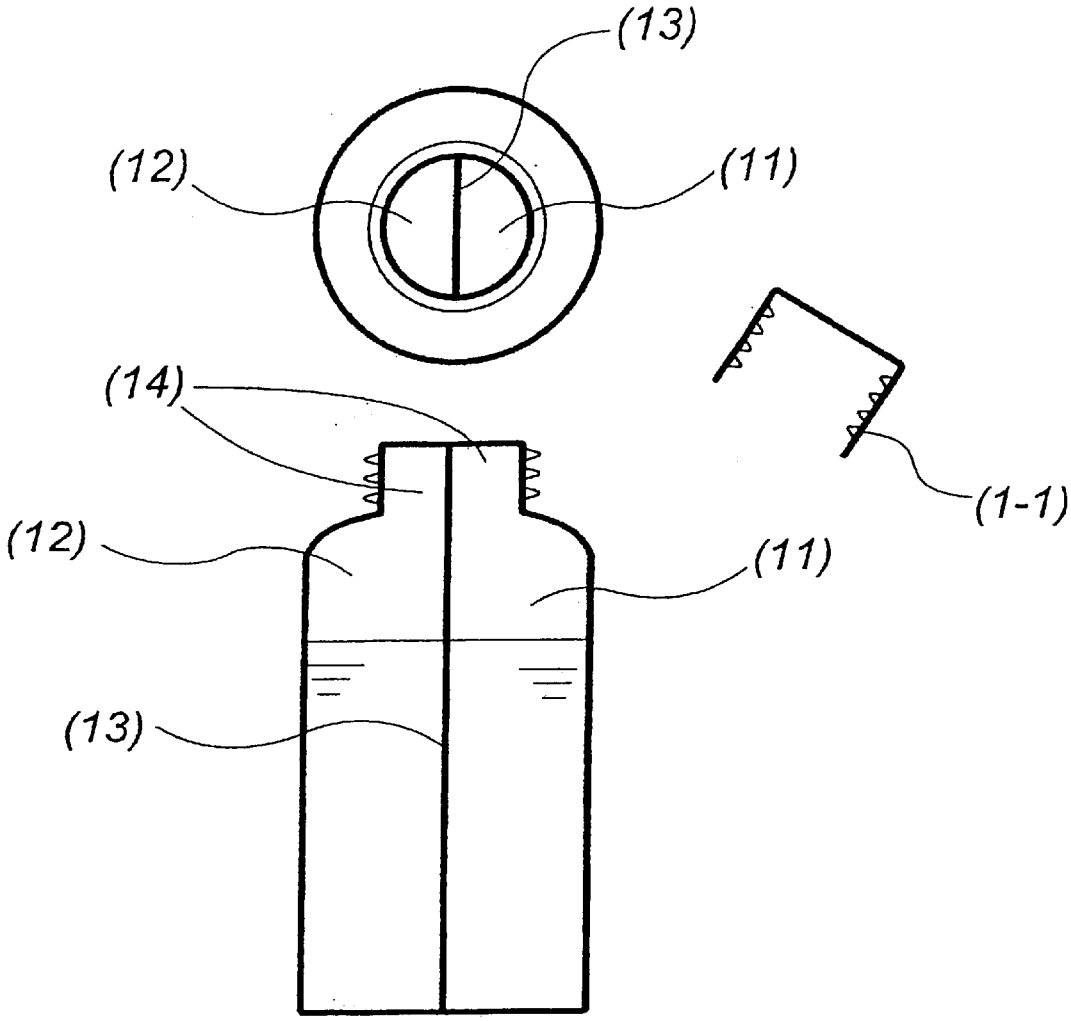
FIG. 1 is a schematic illustration showing one example of a two-agent type container to hold the agent A and the agent B.
Figure 2:
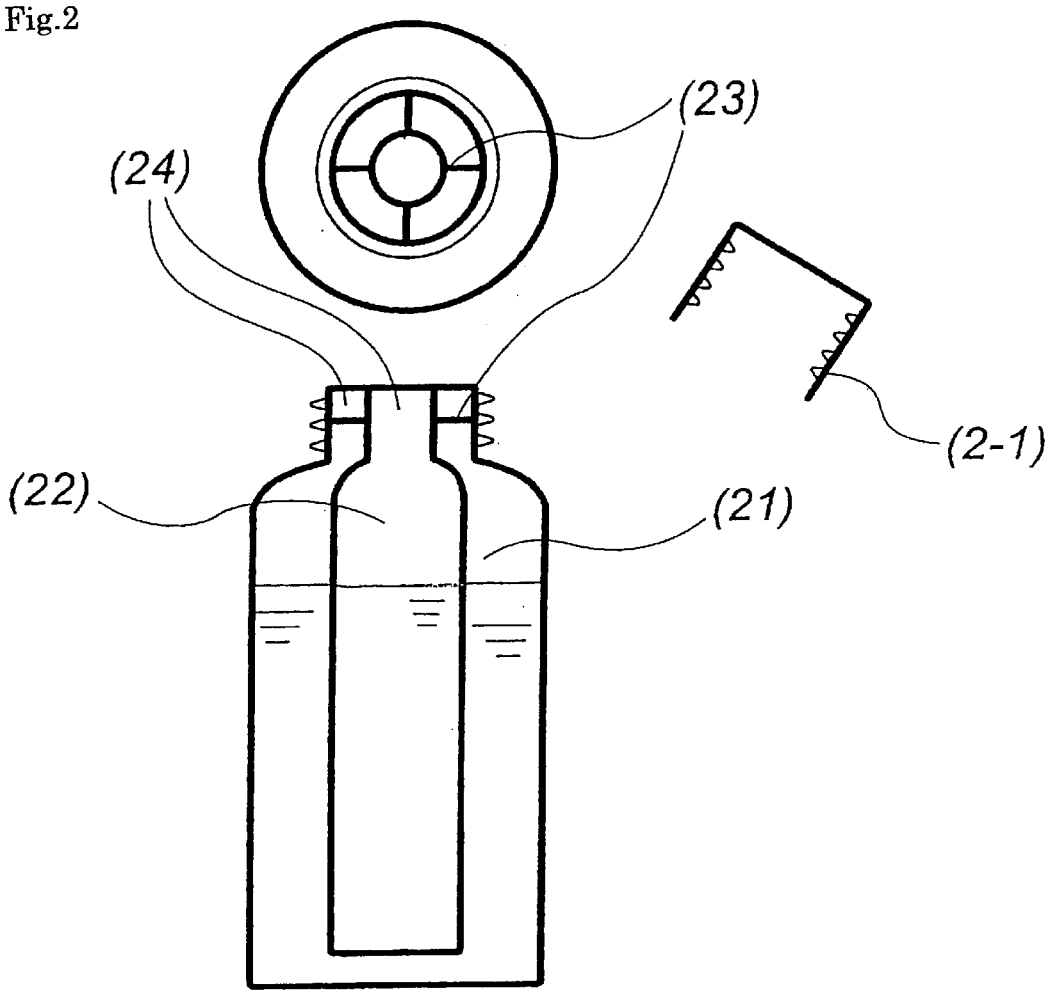
FIG. 2 is a schematic illustration showing another example of a two-agent type container to hold the agent A and the agent B.

Furthermore, it is preferable that the container for use in the present invention is provided with a cap (1-1) or (2-1) shown in FIG. 1 or FIG. 2 capable of measuring the volume of the agent A and the agent B. Utilization of such a cap makes it possible to obtain a mixture of the agent A and the agent B during the process of measurement and the resultant mixture becomes able to act on stains. And therefore high bleaching performance is achieved.

Two-agent type liquid bleaching compositions of the present invention possess excellent storage stability owing to adequate buffering capacity of both the agent A and the agent B, and provide high bleaching effect even if their mixing ratio changes.

EXAMPLE

Examples 1–9, Comparative Examples 1–9

The agent A shown in Table 1 and the agent B shown in Table 2 were filled in containers illustrated in FIG. 1 and FIG. 2 by the combination shown in Table 3, and two-agent type liquid bleaching compositions were prepared. Then storage stability and bleaching effect were evaluated by the following method. The results are shown in Table 3. The containers used are described below.

It should be noted that the pH values shown in Table 1 and Table 2 are those measured at 20° C., and aqueous sulfuric acid solution of 10% by weight or sodium hydroxide solution of 30% by weight was used for pH adjustment.

The pH values shown in Table 3 are those measured at 20° C. for the mixtures in which the agent A and the agent B were mixed so that the mixing weight ratio of the agent A to agent B becomes 3 to 1. It should be noted that, in Examples 1 to 4, pH values of the mixtures of the agent A and the agent B, in which their mixing weight ratio was in the range of from 1/3 to 3/1, were 8.5 or higher at 20° C. in any range of the weight ratio described above.

Further, the volumes of aqueous 0.1 N sodium hydroxide solution required for adjusting 1,000 ml of the agent A to pH 7 at 20° C. (hereinafter referred to as 0.1 N NaOH requirement for agent A) as well as the volumes of aqueous 1 N sulfuric acid solution required for adjusting 1,000 ml of the agent B to pH 7 at 20° C. (hereinafter referred to as 1 N $H_2SO_4$ requirement for agent B) were measured by the following method and their results are shown in Table 1 and Table 2.

Container 1

FIG. 1 shows the shape of container 1 made of polyethylene in which the main body has a diameter of 9 cm and a height of 22 cm, the neck has a diameter of 3.5 cm, and the cap has a diameter of 3.5 cm and a height of 3 cm.

Container 2

FIG. 2 shows the shape of container 2 made of polyethylene. The outer container of the main body has a diameter of 7 cm and a height of 26 cm, and its neck has a diameter of 3.5 cm. The inner container of the main body has a diameter of 4 cm and a height of 25 cm, and its neck has a diameter of 0.9 cm. The cap has a diameter of 3.5 cm and a height of 5 cm. The agent A is filled in container (21) (outer container), while the agent B is filled in container (21) (inner container).

Storage Stability 1 (Bulging of Container caused by Gas Evolution)

Using the two-agent type liquid bleaching compositions listed in Table 3, a mixed solution of the agent A and the agent B was poured into the corresponding cap and then the mixture was poured out from the cap. At this time, the ratio of the agent A to agent B was as shown in Table 3, and the total volume discharged was made to 25 ml in case of the container 1 and 40 ml in case of the container 2. Subsequently, the container was immediately sealed off with the cap and left standing for 2 hours at ambient temperature (23° C.). After this process had been repeated five times, the container was stored in a thermostatic chamber at 40° C. under being sealed off with the cap. After 4 weeks of storage, appearance of the container was determined by visual inspection based on the following criteria:

No bulging of container . . . 5
Slight bulging of container . . . 4
Bulging of container . . . 3
Significant bulging of container . . . 2
Breakage of container . . . 1

An average score was determined with 5 containers, wherein the score 4 or higher was denoted as ○, below 4 and 3 or higher as □, below 3 and 2 or higher as Δ, and below 2 as X, which are shown in Table 3.

Bleaching Effect

Using the two-agent type liquid bleaching compositions listed in Table 3, a total of 1 ml of a mixed solution of the agent A and the agent B (the same mixing ratio of the agent A to agent B as in Table 3) was poured out and then the mixture was applied independently onto 4 sheets of curry-stained cloths (lipophilic stain) prepared as described below, and left standing for 5 minutes. Subsequently, the cloths were dipped in an commercially available detergent solution having a concentration of 0.0667% by weight, washed conventionally with a tergotometer (80 rpm×10 minutes), rinsed with tap water and dried, and then the bleaching efficiency was calculated according to the following equation:

$$\text{Bleaching efficiency (\%)} = \frac{(\text{Reflectance after bleaching} - \text{Reflectance before bleaching})}{(\text{Reflectance of white cloth} - \text{Reflectance before bleaching})} \times 100$$

Reflectance was measured with ND-300A manufactured by Nippon Denshoku Industries Co., Ltd. using a 460 nm filter.

Preparation of Curry-stained Cloth

Retort curry (Curry Marche) produced by House Foods Corp. was filtered through a mesh to remove solid content, and the obtained liquid in a pan was heated to boiling. Into this liquid, tea-dyed muslin #2, 003 was dipped, boiled for about 15 minutes, and put aside as it was. After left standing for 2 hours at ambient temperature, the muslin was taken out and the residual curry liquid adhering to it was removed with a spatula, followed by natural drying. Subsequently, the dried cloth was pressed and subjected to an experiment as test pieces of 10 cm×10 cm.

Measurement of 0.1 N NaOH Requirement for Agent A

Into 1,000 ml of the agent A in a beaker, aqueous 0.1 N NaOH solution was dripped from a burette under mixing, and its pH was monitored using a pH meter (pH Meter F-14; Horiba Ltd.). It should be noted that the measurement was conducted in a constant temperature room of 20° C. keeping every solution and labware at 20° C.

Measurement of 1 N $H_2SO_4$ Requirement for Agent B

Into 1,000 ml of the agent B in a beaker, aqueous 1 N $H_2SO_4$ solution was dripped from a burette under mixing, and its pH was monitored using a pH meter (pH Meter F-14; Horiba Ltd.). It should be noted that the measurement was conducted in a constant temperature room of 20° C. keeping every solution and labware at 20° C.

TABLE 1

| | | | A-1 | A-2 | A-3 | A-4 | A-5 | A-6 |
|---|---|---|---|---|---|---|---|---|
| Agent | Composition | Hydrogen peroxide | 5 | 5 | 5 | 5 | 5 | 5 |
| A | (weight %) | Orthophosphoric acid | 1.0 | | | | | |
| | | Phosphonic acid [1)] | | | | 0.8 | | |
| | | Citric acid | | 1.5 | | | | 20 |

TABLE 1-continued

| | | A-1 | A-2 | A-3 | A-4 | A-5 | A-6 |
|---|---|---|---|---|---|---|---|
| | EDTA [2] | | | 2.0 | | | |
| | Nonion 1 [3] | 1 | 2 | | | 1 | 1 |
| | Nonion 2 [4] | | 30 | 30 | 8 | | |
| | LAS [5] | 1 | 1 | 1 | | 1 | 1 |
| | ES [6] | | 2 | 2 | | | |
| | AOS [7] | | 0.5 | 0.5 | | | |
| | Cation [8] | | 1 | 1 | 0.6 | | |
| | p-Methoxy-phenol | | 0.3 | 0.3 | | | |
| | Sulfobetaine [9] | | 1 | 1 | | | |
| | AOBS [10] | | 1 | | 1 | | |
| | Ion-exchange water | Balance | Balance | Balance | Balance | Balance | Balance |
| | Total | 100 | 100 | 100 | 100 | 100 | 100 |
| pH[#1] | | 2.0 | 4.0 | 4.0 | 2.0 | 6.0 | 2.0 |
| 0.1N NaOHreqirement (ml) | | 230 | 390 | 450 | 170 | 30 | 1200 |

[1] 1-Hydroxyethylidene-1,1-diphosphonic acid
[2] Ethylenediaminetetraacetic acid
[3] Polyoxyethylene lauryl ether (average EO addition number in moles; 6)
[4] $RO(C_2H_4O)_n(C_3H_6O)_m$—H (R: lauryl, n: 5, m: 3)
[5] Alkyl ($C_{12-15}$) benzenesulfonic acid sodium salt
[6] Sodium salt of polyoxyethylene lauryl ether sulfate (average EO addition number in moles; 2)
[7] α-Alkenyl ($C_{16}$) sulfonic acid sodium salt
[8] N-Tetradecyl-N,N,N-trimethylammonium chloride
[9] N-Lauryl-N,N-dimethyl-N-(2-hydroxy-1-sulfopropyl) ammonium sulfobetaine
[10] Lauroyloxybenzenesulfonic acid sodium salt

TABLE 2

| | | | B-1 | B-2 | B-3 | B-4 | B-5 | B-6 |
|---|---|---|---|---|---|---|---|---|
| Agent B | Composition (weight %) | Sodium carbonate | 10 | | | | 1 | |
| | | Potassium carbonate | | 6 | | 8 | | 20 |
| | | Sodium hydrogen carbonate | | 0.3 | | | | |
| | | Monoethanolamine | | | 10 | | | |
| | | Polymer [11] | | | 6 | 7 | | 1 |
| | | Sulfobetaine [9] | | 4 | 2 | 3 | 4 | |
| | | Nonion2 [4] | 4 | | 30 | | | |
| | | LAS [5] | | 3 | 5 | | 3 | |
| | | ES [6] | | | 2 | | | |
| | | Propylene glycol | | | 10 | | | |
| | | Phosphonic acid [1] | | | 0.1 | 0.1 | | 0.2 |
| | | PTS [12] | | | 2 | 2 | | |
| | | Ion-exchange water | Balance | Balance | Balance | Balance | Balance | Balance |
| | | Total | 100 | 100 | 100 | 100 | 100 | 100 |
| pH[#1] | | | 10.8 | 10.9 | 10.7 | 10.8 | 9.8 | 12.5 |
| 1N $H_2SO_4$requirement (ml) | | | 650 | 580 | 510 | 640 | 180 | 2300 |

[11] Polyacrylic acid sodium salt (weight average molecular weight; 10,000)
[12] p-Toluenesulfonic acid sodium salt

TABLE 3

| | | Example | | | | Comparative example | | | |
|---|---|---|---|---|---|---|---|---|---|
| | | 1 | 2 | 3 | 4 | 1 | 2 | 3 | 4 |
| Two-agent type bleaching composition | Agent A | A-1 | A-2 | A-3 | A-4 | A-1 | A-2 | A-5 | A-6 |
| | Agent B | B-1 | B-2 | B-3 | B-4 | B-5 | B-6 | B-1 | B-1 |
| | pH of mixture (20° C.) | 10.3 | 10.5 | 10.4 | 10.3 | 8.2 | 11.6 | 10.7 | 8.1 |
| | Container used | Con-tainer 1 | Con-tainer 2 | Con-tainer 2 | Con-tainer 2 | Con-tainer 1 | Con-tainer 2 | Con-tainer 1 | Con-tainer 1 |

TABLE 3-continued

| | | Example | | | | Comparative example | | | |
|---|---|---|---|---|---|---|---|---|---|
| | | 1 | 2 | 3 | 4 | 1 | 2 | 3 | 4 |
| | Filling volume of agent A (ml) | 300 | 400 | 400 | 400 | 300 | 400 | 300 | 300 |
| | Filling volume of agent B (ml) | 300 | 200 | 200 | 200 | 300 | 200 | 300 | 300 |
| | Discharge volume ratio of Agent A to Agent B (mass ratio) | 1/1 | 2/1 | 2/1 | 2/1 | 1/1 | 2/1 | 1/1 | 1/1 |
| | pH of discharged liquid (20° C.) | 10.6 | 10.7 | 10.5 | 10.5 | 9.1 | 11.8 | 11.6 | 8.4 |
| Evaluation Result | Storage stability (Deformation of container) | ○ | ○ | ○ | ○ | ○ | X | X | ○ |
| | Bleaching efficiency (%) | 82 | 86 | 84 | 84 | 54 | 75 | 84 | 52 |

Two-agent type liquid bleaching compositions prepared with the agent A shown in Table 1 and the agent B shown in Table 2 by the combination shown in Table 4 were evaluated for their bleaching effect by varying the ratio of discharge volume of the agent A and the agent B as shown in Table 4. For this evaluation, 400 ml of the agent A and 200 ml of the agent B were filled in the container illustrated in FIG. 2, and the ratios of their respective discharge volumes were varied by adjusting the opening area of the pour spout. Bleaching effect was evaluated by the method described above, and its values 65% or higher were denoted as ○, below 65% and 40% or higher as Δ, and below 40% as X. These results are shown in Table 4.

TABLE 4

| | | Example | | | | | Comparative example | | | | |
|---|---|---|---|---|---|---|---|---|---|---|---|
| | | 5 | 6 | 7 | 8 | 9 | 5 | 6 | 7 | 8 | 9 |
| Two-agent type bleaching composition | Agent A | A-1 | A-1 | A-1 | A-1 | A-1 | A-1 | A-1 | A-1 | A-1 | A-1 |
| | Agent B | B-1 | B-1 | B-1 | B-1 | B-1 | B-5 | B-5 | B-5 | B-5 | B-5 |
| | Discharge volume ratio of agent A to agent B (mass ratio) | 1/10 | 1/3 | 1/1 | 3/1 | 10/1 | 1/10 | 1/3 | 1/1 | 3/1 | 10/1 |
| | pH of discharged liquid PH (20° C.) | 10.7 | 10.6 | 10.6 | 10.3 | 9.5 | 8.8 | 8.5 | 8.4 | 8.2 | 7.6 |
| Evaluation result | Bleaching efficiency (%) | ○ | ○ | ○ | ○ | ○ | ○ | Δ | Δ | Δ | X |

Examples 10–12, Comparative Examples 10–14

The agent A and the agent B both shown in Table 5 were filled in the container illustrated in FIG. 1 or FIG. 2 by the combination shown in Table 5 to prepare two-agent type liquid bleaching compositions, and their bleaching effect was evaluated according to the same method as that in Example 1. In addition, formation of liquid turbidity or precipitates after the agent A and the agent B were stored (storage stability 2 (liquid condition)) was evaluated by the following method and the results are shown in Table 1:

Storage Stability 2 (Liquid Condition)

100 g each of the agent A and the agent B was put in 100 ml screw tubes, and stored for one week at 20° C. Then evaluation was conducted by visual inspection according to the following criteria:

Measurement of Peroxy Acid Generation

A total amount of 0.8 g of the agent A and the agent B at the discharge volume ratio shown in Table 8 was measured, added to an aqueous solution of a commercially available powder detergent (0.067% by weight, 20° C., 1 L) and

TABLE 5

| | | | Example | | | Comparative example | | | | |
|---|---|---|---|---|---|---|---|---|---|---|
| | | | 10 | 11 | 12 | 10 | 11 | 12 | 13 | 14 |
| two agent type bleach | | | A-7 | A-8 | A-9 | A-7 | A-8 | A-9 | A-8 | A-8 |
| | Agent A | Hydrogen peroxide | 5 | 4 | 3 | 5 | 4 | 3 | 4 | 4 |
| | | Orthophosphoric acid | 0.1 | | | 0.1 | | | | |
| | | Phosphonic acid [1] | | 0.2 | | | 0.2 | | 0.2 | 0.2 |
| | | Citric acid | | | 0.4 | | | 0.4 | | |
| | | Nonion(1) [2] | 8 | 10 | 10 | 8 | 10 | 10 | 10 | 10 |
| | | Cation [3] | | 1 | 0.5 | | 1 | 0.5 | 1 | 1 |
| | | AOBS [4] | | 1 | 0.5 | | 1 | 0.5 | 1 | 1 |
| | | Ion-exchange water | Balance | Balance | Balance | Balance | Balance | Balance | Balance | Balance |
| | | Total | 100 | 100 | 100 | 100 | 100 | 100 | 100 | 100 |
| | | pH (20° C.) | 4.0 | 2.5 | 6.0 | 4.0 | 2.5 | 6.0 | 2.5 | 2.5 |
| | 0.1N NaOH requirement (ml) | | 81 | 184 | 60 | 81 | 184 | 60 | 184 | 184 |
| | storange stability of agent A | | ○ | ○ | ○ | ○ | ○ | ○ | ○ | ○ |
| | | | B-7 | B-8 | B-9 | B-10 | B-11 | B-12 | B-13 | B-14 |
| | Agent B | Potassium carbonate | 5 | 6 | 10 | | | | 2 | 20 |
| | | Sodium carbonate | | | | | 6 | 10 | | |
| | | Sodium hydrogen carbonate | | | | 5 | | | | |
| | | Polymer [5] | | 6 | 5 | | 6 | 5 | 6 | 6 |
| | | LAS [6] | 1 | | | 1 | | | | |
| | | Nonion(2) [7] | 2 | | 3 | 2 | | 3 | | |
| | | Sulfobetaine [8] | 3 | 5 | | 3 | 5 | | 5 | 5 |
| | | Phosphonic acid [1] | | 0.1 | | | 0.1 | | 0.1 | 0.1 |
| | | Ion-exchange water | Balance | Balance | Balance | Balance | Balance | Balance | Balance | Balance |
| | | Total | 100 | 100 | 100 | 100 | 100 | 100 | 100 | 100 |
| | | Potassium ion concentration (weight %) | 2.8 | 3.4 | 5.7 | 0 | 0 | 0 | 1.1 | 11.3 |
| | | $K^+/[M^+ + Me^{2+}]$ [9] | 97.8 | 69.8 | 82.3 | 0 | 0 | 0 | 42.8 | 88.5 |
| | | pH (20° C.) | 11.5 | 10.9 | 11.7 | 11.5 | 10.9 | 11.7 | 10.9 | 10.9 |
| | 1N $H_2SO_4$ requirement (ml) | | 460 | 624 | 819 | 823 | 925 | 1540 | 198 | 2300 |
| | storange stability of agent B | | ○ | ○ | ○ | Δ | Δ | X | ○ | X |
| | Container | | FIG. 1 | FIG. 2 | FIG. 1 | FIG. 1 | FIG. 2 | FIG. 1 | FIG. 2 | FIG. 2 |
| | Filling volume of agent A (ml) | | 300 | 400 | 300 | 300 | 400 | 300 | 400 | 400 |
| | Filling volume of agent B (ml) | | 300 | 200 | 300 | 300 | 200 | 300 | 200 | 200 |
| | Discharge volume ratio of agent A to agent B (weight %) | | 1 | 2 | 1 | 1 | 2 | 1 | 2 | 2 |
| | pH of discharged liquid (20° C.) | | 10.3 | 10 | 10.4 | 10 | 9.8 | 10.6 | 9.1 | 10.2 |
| Evaluation result | Bleaching efficiency (%) | | 75 | 81 | 78 | 60 | 57 | 61 | 52 | 65 |

○ . . . homogeneous clear liquid
Δ . . . milky turbid liquid
X . . . precipitates observed
[1] 1-Hydroxyethylidene-1,1-diphosphonic acid
[2] Polyoxyethylene lauryl ether (average EO addition number in moles; 6)
[3] N-Tetradecyl-N,N,N-trimethylammonium chloride
[4] Lauroyloxybenzenesulfonic acid sodium salt
[5] Polyacrylic acid sodium salt (weight average molecular weight; 10,000)
[6] Alkyl ($C_{12-15}$) benzenesulfonic acid sodium salt
[7] $RO(C_2H_4O)_n(C_3H^6O)_m(C_2H_4O)_1$—H (R: lauryl, n: 6, m: 1, l: 4)
[8] N-Lauryl-N,N-dimethyl-N-(2-hydroxy-1-sulfopropyl) ammonium sulfobetaine
[9] The weight ratio of a total amount of alkali metal ion and alkali earth metal ion to potassium ion Examples 13–16, Comparative Examples 15–17

The agent A shown in Table 6 (A-10 to A-12) and the agent B shown in Table 7 (B-15 to B-18) were filled in the container illustrated in FIG. 1 or FIG. 2 by the combination shown in Table 8 to prepare two-agent type liquid bleaching compositions, and their bleaching effect was evaluated according to the same method as that described above. In addition, peroxy acid formation was measured by the method described below. These results are shown in Table 8. It should be noted that all of the agent A and the agent B meet the conditions of (I) and (II) of the present invention, respectively. Further, all combinations of the agent A and the agent B in Examples 10 to 13 result in pH of 8.5 or higher at any mixing ratio (weight ratio) of 1/3 to 3/1.

mixed for 5 minutes, followed by an addition of 10 ml of 0.1% by weight solution of catalase and further mixing for 1 minute. To this solution were added 10 ml of 10% by weight solution of potassium iodide and 20 ml of 20% by weight solution of sulfuric acid, followed by titration with 0.01 N sodium thiosulfate solution. The rate of peroxy acid generation was calculated by the following equation:

Rate of peroxy acid generation (%)=*f*/100×titraion vol (ml)/1,000×½×molecular weight of peroxy acid precursor/(sampling amount of composition (g)×content of peroxy acid precursor in composition (%))×100

Herein, higher ratio of peroxy acid generation gives higher bleaching performance.

TABLE 6

| | | | A-10 | A-11 | A-12 |
|---|---|---|---|---|---|
| Agent A | Composition (weight %) | Hydrogen peroxide | 5 | 5 | 5 |
| | | Nonion [1] | 2 | 15 | 10 |
| | | Nonion [2] | | 8 | |
| | | LAS [3] | 1 | 5 | |
| | | ES [4] | 1 | | |
| | | AOS [5] | 0.5 | 0.5 | |
| | | Cation [6] | | 1 | 1 |
| | | p-methoxyphenol | 0.1 | 0.1 | |
| | | AOBS [7] | 1 | 1 | 1 |

TABLE 6-continued

| | | A-10 | A-11 | A-12 |
|---|---|---|---|---|
| | Phosphonic acid [8] | 1 | 1 | 0.2 |
| | Polymer [9] | | 0.5 | |
| | Ion-exchange water | Balance | Balance | Balance |
| | Total | 100 | 100 | 100 |
| pH [#1] | | 6 | 4 | 3 |
| 0.1NNaOH requirement (ml) | | 180 | 214 | 170 |
| storage stability (liquid condition) | | ○ | ○ | ○ |

TABLE 7

| | | B-15 | B-16 | B-17 | B-18 |
|---|---|---|---|---|---|
| Agent B Composition (weight %) | Potassium carbonate | 7 | 5 | 7 | 5 |
| | Amine oxide [10] | 3 | 3 | | |
| | Polymer [9] | 5 | 5 | 5 | 5 |
| | ES [4] | | 2 | | 2 |
| | Propylene glycol | | 2 | | 2 |
| | PTS [11] | | 0.5 | | 0.5 |
| | Ion-exchange water | Balance | Balance | Balance | Balance |
| | Total | 100 | 100 | 100 | 100 |
| pH (20° C.) | | 10.6 | 11.5 | 10.6 | 11.5 |
| 1N $H_2SO_4$ requirement (ml) | | 570 | 512 | 559 | 500 |
| storange stability (liquid condition) | | ○ | ○ | ○ | ○ |

[1] Polyoxyethylene lauryl ether (average EO addition number in moles; 6)
[2] $RO(C_2H_4O)_n(C_3H_6O)_m$—H (R: lauryl, n: 5, m: 3)
[3] Alkyl ($C_{12-15}$) benzenesulfonic acid sodium salt
[4] Sodium salt of polyoxyethylene lauryl ether sulfate (average EO addition number in moles; 5)
[5] α-Alkenyl ($C_{16}$) sulfonic acid sodium salt
[6] N-Tetradecyl-N,N,N-trimethylammonium chloride
[7] Lauroyloxybenzenesulfonic acid sodium salt
[8] 1-Hydroxyethylidene-1,1-diphosphonic acid
[9] Polyacrylic acid sodium salt (weight average molecular weight: 1,000)
[10] Lauryldimethylamine oxide
[11] p-Toluenesulfonic acid sodium salt

TABLE 8

| | | Example | | | | Comparative example | | |
|---|---|---|---|---|---|---|---|---|
| | | 13 | 14 | 15 | 16 | 15 | 16 | 17 |
| Two-agent type bleaching composition | Agent A | A-10 | A-11 | A-12 | A-12 | A-10 | A-11 | A-12 |
| | Agent B | B-15 | B-16 | B-15 | B-16 | B-17 | B-18 | — |
| | | FIG. 1 | FIG. 2 | FIG. 2 | FIG. 1 | FIG. 1 | FIG. 2 | FIG. 2 |
| | Filling volume of agent A (ml) | 300 | 400 | 400 | 300 | 300 | 400 | 600 |
| | Filling volume of agent B (ml) | 300 | 200 | 200 | 300 | 300 | 200 | 0 |
| | Discharge volume ratio of agent A to agent B | 1 | 2 | 2 | 1 | 1 | 2 | — |
| | pH of discharged liquid | 10.6 | 10.2 | 10.4 | 10.2 | 10.6 | 10.2 | 3.0 |
| Evaluation result | Rate of peroxy acid generation (%) | 67 | 66 | 68 | 65 | 47 | 46 | 31 |
| | Bleaching efficiency (%) | 81 | 82 | 78 | 83 | 55 | 58 | 45 |

TABLE 8-continued

| | Example | | | | Comparative example | | |
|---|---|---|---|---|---|---|---|
| | 13 | 14 | 15 | 16 | 15 | 16 | 17 |
| Storange stability (Deformation of container) | ○ | ○ | ○ | ○ | ○ | ○ | ○ |

What is claimed is:

1. Two-agent type liquid bleaching compositions made of an agent A and an agent B filled and held in separate chambers of a container, said two-agent type liquid bleaching compositions comprising:

said agent A composed of hydrogen peroxide which contains 0.1 to 10% by weight, an acid agent and water; and said agent B composed of an alkali agent and water, wherein said agent A and said agent B meet the following conditions of (I) and (II), respectively:

(I) A pH of said agent A ranges from 1 to 6.5 at 20° C. and a volume of aqueous 0.1 N sodium hydroxide solution required to adjust a pH of 1,000 ml of said agent A to 7 at 20° C. is from 50 to 1,000 ml; and (II) A pH of said agent B ranges from 9 to 12 at 20° C. and a volume of aqueous 1 N sulfuric acid solution required to adjust a pH of 1,000 ml of said agent B to 7 at 20° C. is from 450 to 2,000 ml.

2. The two-agent type liquid bleaching compositions according to claim 1, wherein a pH of a mixture mixed at a weight ratio of said agent A to said agent B ranging from 1/3 to 3/1 is always 8.5 or higher at 20° C. in said any weight ratio.

3. The two-agent type liquid bleaching compositions according to claim 1, wherein a compound having two or more acid functions with their acid dissociation constants, pKa, of 1 to 8 is included in said agent A as said acid agent at a content of 0.2 to 10% by weight.

4. The two-agent type liquid bleaching compositions according to claim 1, wherein the constituents of said agent B contain from 3.5 to 15% by weight of one or more of the compounds selected from sodium hydroxide, potassium hydroxide, sodium carbonate, potassium carbonate, monoethanolamine, diethanolamine, triethanolamine, trisodium phosphate, disodium phosphate, and sodium tetraborate.

5. The two-agent type liquid bleaching compositions according to claim 1, wherein the constituents of said agent B contain from 1.5 to 10% concentration by weight of potassium ion.

6. The two-agent type liquid bleaching compositions according to claim 4, wherein the ratio of potassium ion to a total amount of alkali metal ion and alkali-earth metal ion existing in said agent B is from 50 to 100% by weight.

7. The two-agent type liquid bleaching compositions according to claim 1, wherein the constituents of said agent A further contain from 0. 05 to 10% by weight of a bleach activator having an ester group, an imide group or a nitrile group.

8. The two-agent type liquid bleaching compositions according to claim 7, wherein said bleach activator is represented by the following formula (1):

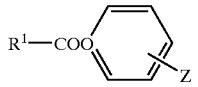

(1)

(wherein $R^1$ represents a straight chain or branched chain alkyl or alkenyl group having from 5 to 19 carbon atoms and Z represents —$SO_3M$ or COOM further, M represents an organic or inorganic cation.)

9. The two-agent type liquid bleaching compositions according to claim 8, wherein said agent B further contains from 0.01 to 50% by weight of an amine oxide form of a surfactant.

10. A method of bleaching an article, comprising mixing an agent A and an agent B with each other at a weight ratio ranging from 1/3 to 3/1 and then bringing the mixture into contact with the article:

the agent A composed of constituents including hydrogen peroxide which contains 0.1 to 10% by weight, an acid agent and water, and satisfying the condition of (I) described below, and the agent B composed of constituents including an alkali agent and water, and indicating the condition of (II) described below, (I) A pH of said agent A ranges from 1 to 6.5 at 20° C. and a volume of aqueous 0.1 N sodium hydroxide solution required to adjust a pH of 1,000 ml of said agent A to 7 at 20° C. is from 50 to 1,000 ml; and (II) A pH of said agent B ranges from 9 to 12 at 20° C. and a volume of aqueous 1 N sulfuric acid solution required to adjust a pH of 1,000 ml of said agent B to 7 at 20° C. is from 450 to 2,000 ml.

* * * * *